US011105564B2

(12) United States Patent
Takeda et al.

(10) Patent No.: US 11,105,564 B2
(45) Date of Patent: Aug. 31, 2021

(54) PLATE STACK AND HEAT EXCHANGER

(71) Applicant: MAYEKAWA MFG. CO., LTD., Tokyo (JP)

(72) Inventors: Masato Takeda, Tokyo (JP); Yasushi Tomiyama, Tokyo (JP); Nelson Mugabi, Tokyo (JP); Yuki Matsumoto, Tokyo (JP)

(73) Assignee: MAYEKAWA MFG. CO., LTD., Tokyo (JP)

( * ) Notice: Subject to any disclaimer, the term of this patent is extended or adjusted under 35 U.S.C. 154(b) by 58 days.

(21) Appl. No.: 16/645,625

(22) PCT Filed: Sep. 11, 2019

(86) PCT No.: PCT/JP2019/035608
§ 371 (c)(1),
(2) Date: Mar. 9, 2020

(87) PCT Pub. No.: WO2020/059578
PCT Pub. Date: Mar. 26, 2020

(65) Prior Publication Data

US 2021/0222961 A1 Jul. 22, 2021

(30) Foreign Application Priority Data

Sep. 19, 2018 (JP) ..... JP2018-174335

(51) Int. Cl.
*F28F 3/00* (2006.01)
*F28F 3/04* (2006.01)
*F28D 9/00* (2006.01)

(52) U.S. Cl.
CPC ..... *F28F 3/046* (2013.01); *F28D 9/005* (2013.01); *F28D 9/0037* (2013.01)

(58) Field of Classification Search
CPC . F28F 3/046; F28F 3/048; F28F 3/044; F28D 9/005; F28D 9/0037; F28D 9/0043
(Continued)

(56) References Cited

U.S. PATENT DOCUMENTS 5,184,673 A * 2/1993 Hedman ..... B23K 1/0012 165/153
5,755,279 A * 5/1998 Sweeney ..... F25J 5/005 165/115
(Continued)

FOREIGN PATENT DOCUMENTS

CN 1842689 A 10/2006
CN 103759474 A 4/2014
(Continued)

OTHER PUBLICATIONS

Office Action issued in Japanese Appln. No. 2018-174335 dated Jun. 16, 2020. English machine translation provided.
(Continued)

*Primary Examiner* — Claire E Rojohn, III
(74) *Attorney, Agent, or Firm* — Rossi, Kimms & McDowell LLP

(57) ABSTRACT

A plate stack includes a plurality of plates, each including corrugated portions formed on front and back surfaces thereof. First and second heat exchange flow passages are formed between plates, arranged alternately along stacking direction of the plates. Each plate has two through holes penetrating the front and back surfaces, through which the first heat exchange fluid is introduced and derived. The plate stack includes first partition weirs formed on at least one of two plate surfaces, the two plate surfaces forming a corresponding one of the first heat exchange flow passages therebetween. First partition weirs are symmetrically and obliquely arranged with respect to a center line connecting centers of two through holes as viewed from the stacking
(Continued)

direction. A flow passage is formed along the center line on a side of at least one of the two through holes, from which first heat exchange fluid is introduced.

14 Claims, 6 Drawing Sheets

(58) Field of Classification Search
USPC ..... 165/166
See application file for complete search history.

(56) References Cited

U.S. PATENT DOCUMENTS

| | | | | |
|---|---|---|---|---|
| 9,759,498 | B2 * | 9/2017 | Kim | F01M 5/007 |
| 9,920,686 | B2 * | 3/2018 | Somhorst | F02B 29/0462 |
| 9,989,322 | B2 * | 6/2018 | Cheadle | F01N 5/02 |
| 10,047,703 | B1 * | 8/2018 | Lee | F02M 26/32 |
| 10,396,415 | B2 * | 8/2019 | Foerster | F28F 3/12 |
| 10,697,405 | B2 * | 6/2020 | Ohrem | F02M 26/12 |
| 10,797,366 | B2 * | 10/2020 | Kopp | H01M 10/6568 |
| 10,808,592 | B2 * | 10/2020 | Seon | F28D 21/0003 |
| 10,914,533 | B2 * | 2/2021 | Somhorst | F28F 3/042 |
| 2006/0191672 | A1 * | 8/2006 | Stenhede | F28D 9/0006 165/145 |
| 2011/0120672 | A1 * | 5/2011 | Ringwaldt | F28D 3/00 165/104.14 |
| 2012/0017575 | A1 * | 1/2012 | Sloss | F28F 27/02 60/320 |
| 2014/0216702 | A1 * | 8/2014 | Vallee | F28F 3/044 165/168 |
| 2014/0251579 | A1 * | 9/2014 | Sloss | F01N 5/02 165/96 |
| 2015/0000869 | A1 * | 1/2015 | Denoual | F28F 27/02 165/96 |
| 2016/0010531 | A1 * | 1/2016 | Domínguez | F01N 3/0205 60/320 |
| 2016/0356560 | A1 * | 12/2016 | Wei | F28F 9/026 |
| 2017/0003058 | A1 * | 1/2017 | Andersson | F25B 39/026 |
| 2017/0122668 | A1 * | 5/2017 | Fujii | B01D 1/22 |
| 2017/0335740 | A1 * | 11/2017 | Dries | F28F 3/046 |
| 2017/0362988 | A1 * | 12/2017 | Matsuura | F28F 3/06 |
| 2018/0003097 | A1 * | 1/2018 | Godard | F01N 5/02 |
| 2018/0128549 | A1 * | 5/2018 | Takeda | F28F 3/04 |
| 2018/0171940 | A1 * | 6/2018 | González | F28F 27/02 |

FOREIGN PATENT DOCUMENTS

| | | | |
|---|---|---|---|
| CN | 103975214 | A | 8/2014 |
| CN | 104296585 | A | 1/2015 |
| CN | 105829821 | A | 8/2016 |
| CN | 107532854 | A | 1/2018 |
| EP | 3372941 | A1 | 9/2018 |
| JP | 2006527835 | A | 12/2006 |
| JP | 5690532 | B2 | 3/2015 |
| JP | 5733866 | B1 | 6/2015 |
| JP | 2016515180 | A | 5/2016 |
| JP | 2016148491 | A | 8/2016 |
| JP | 2017003175 | A | 1/2017 |
| JP | 2017089918 | A | 5/2017 |
| JP | 2018054215 | A | 4/2018 |
| KR | 101345733 | B1 | 12/2013 |
| KR | 1020150121232 | A | 10/2015 |
| KR | 1020170135936 | A | 12/2017 |

OTHER PUBLICATIONS

International Search Report issued in Intl. Appln. No. PCT/JP2019/035608 dated Dec. 12, 2019. English translation provided.
Written Opinion issued in Intl. Appln. No. PCT/JP2019/035608 dated Dec. 12, 2019.
Office Action issued in Korean Appln. No. 10-2020-7009338 dated Apr. 22, 2021. English machine translation provided.
Office Action issued in Chinese Appln. No. 201980004817.7 dated Dec. 21, 2020.

* cited by examiner

[Fig. 1]
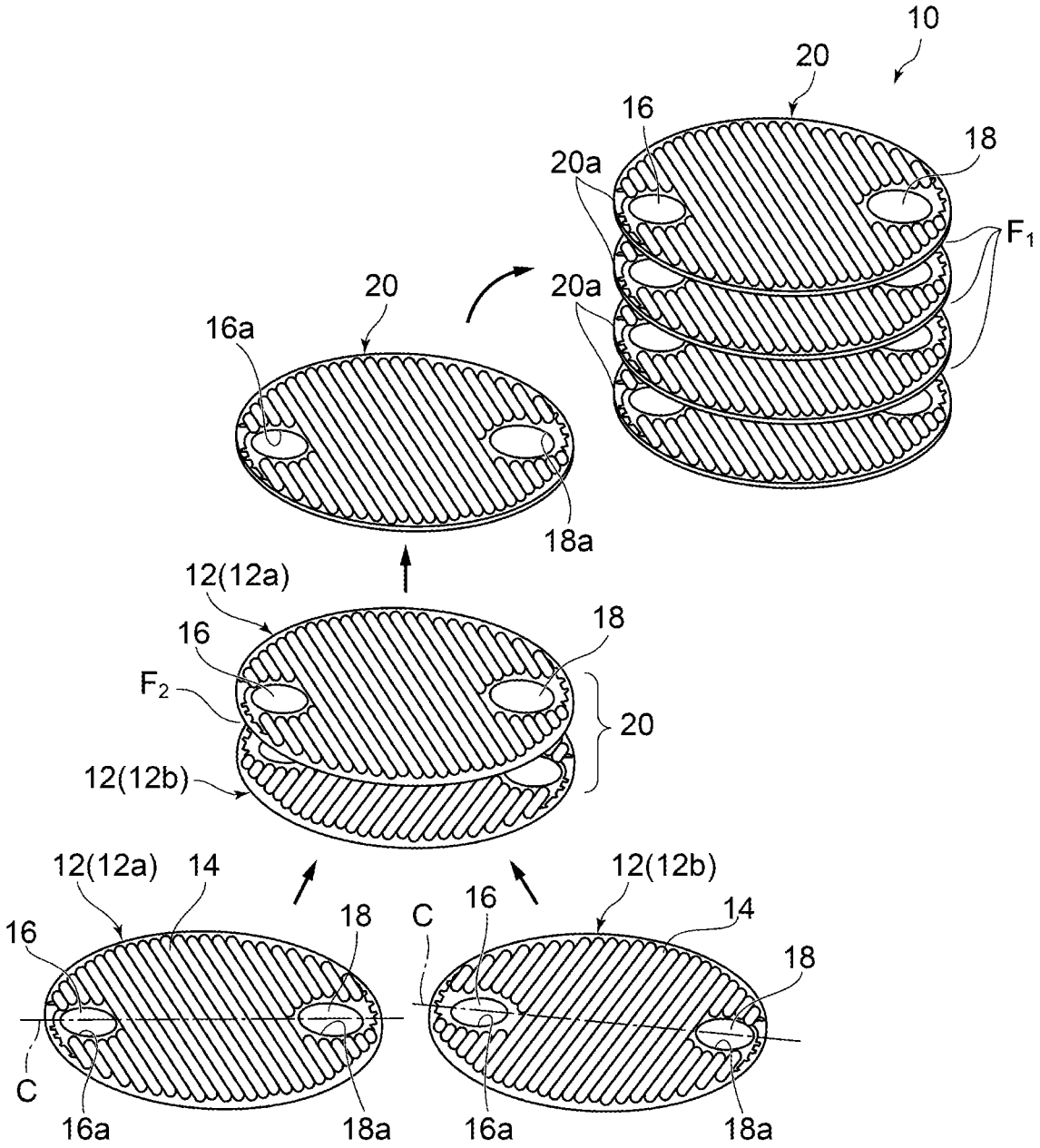

[Fig. 2]
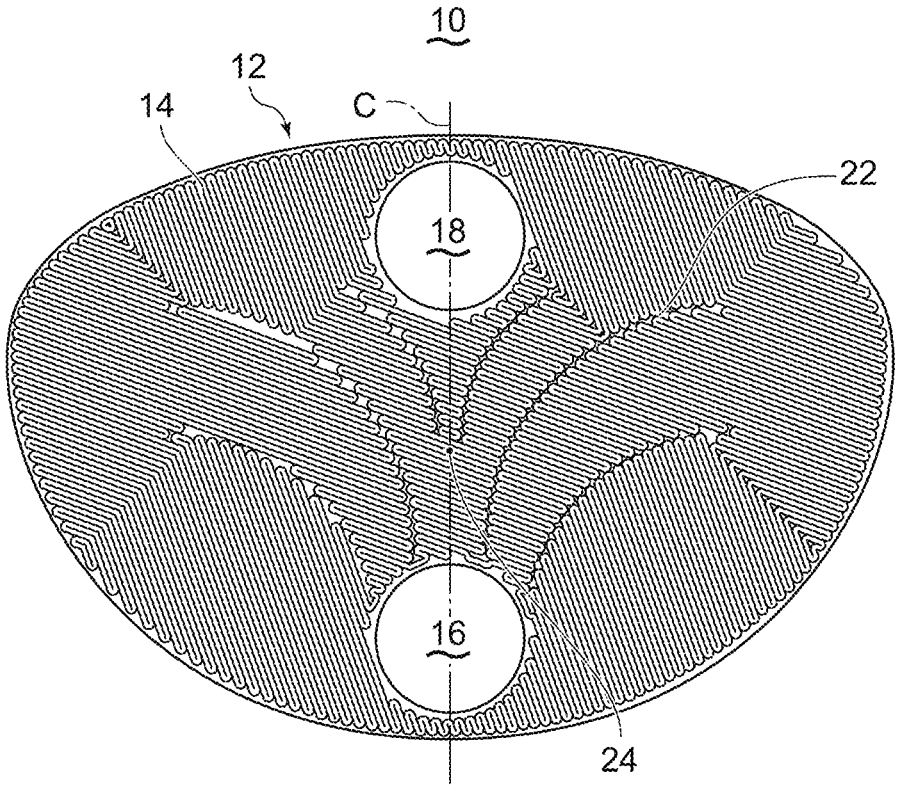
[Fig. 3]
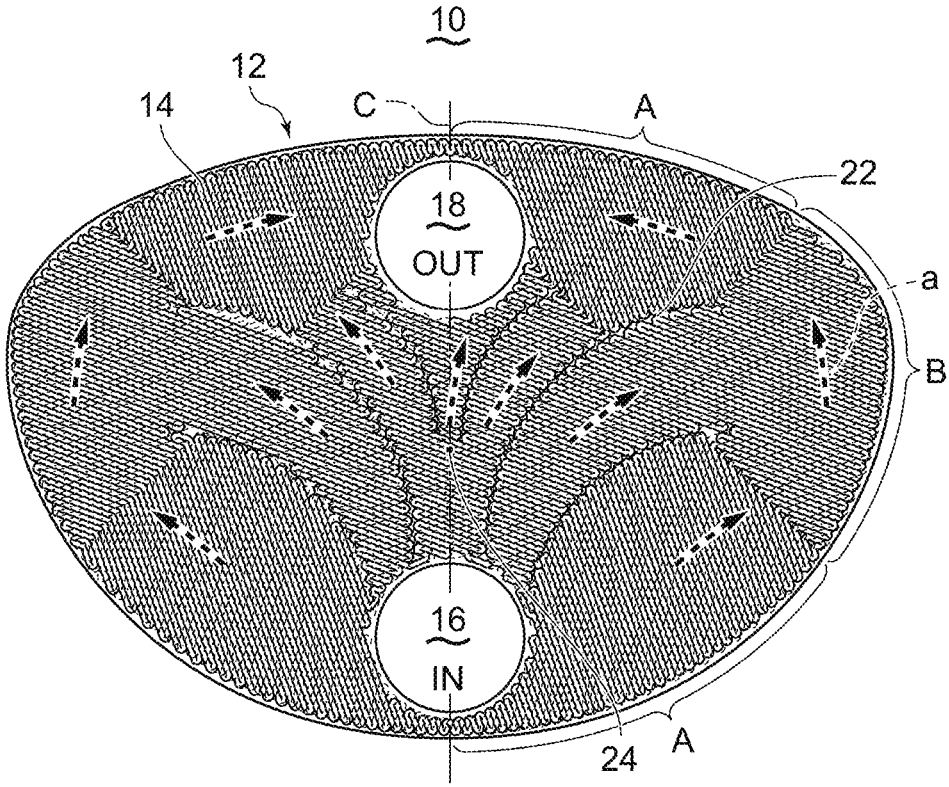

[Fig. 4]
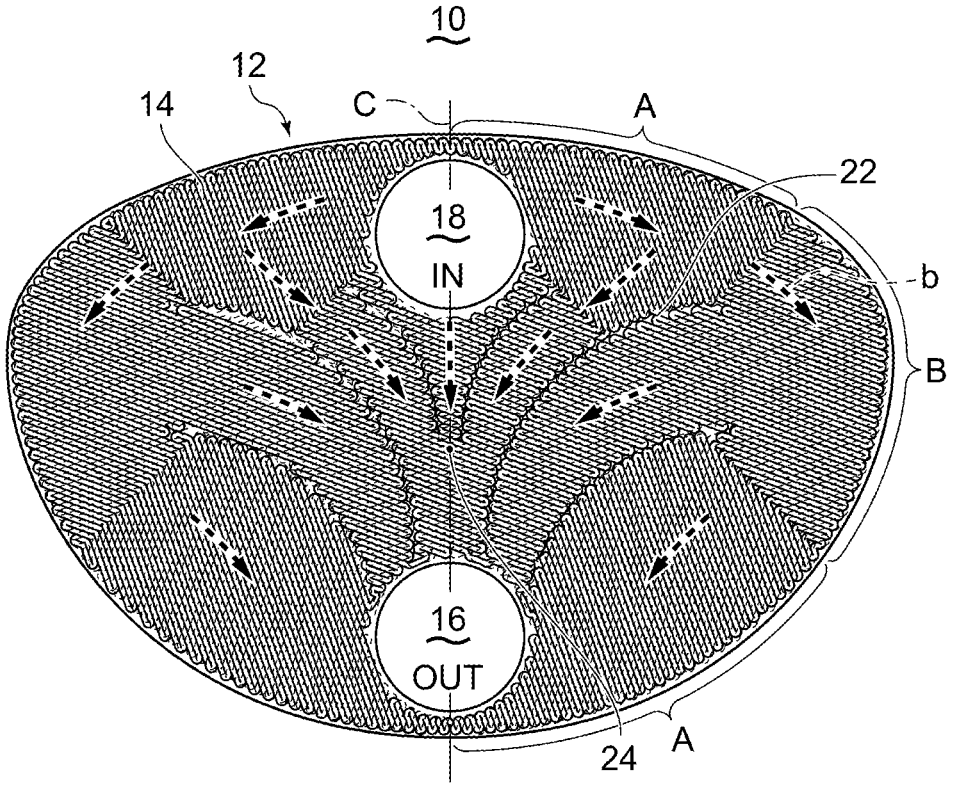

[Fig. 5A]
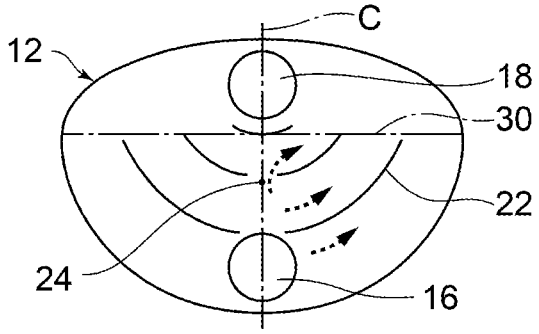
[Fig. 5B]
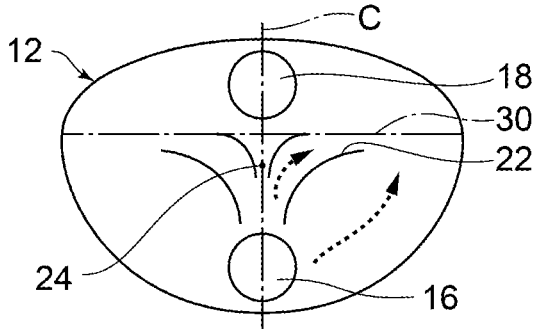
[Fig. 5C]
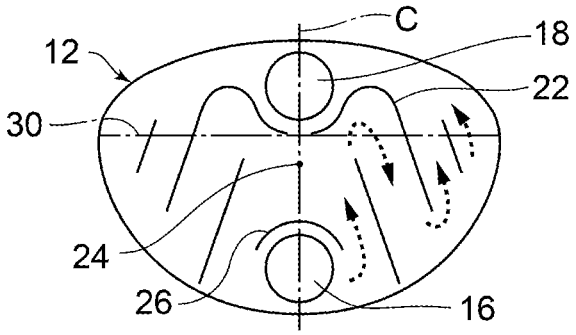
[Fig. 5D]
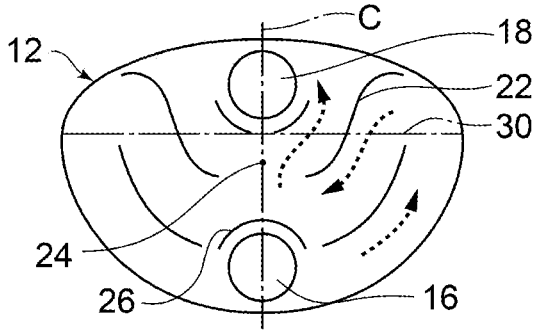

[Fig. 6]
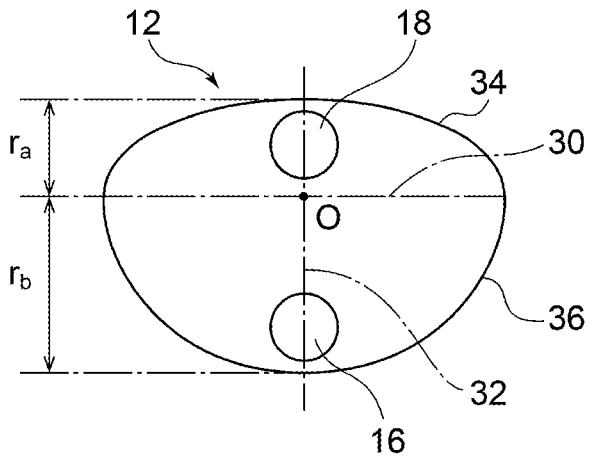
[Fig. 7]
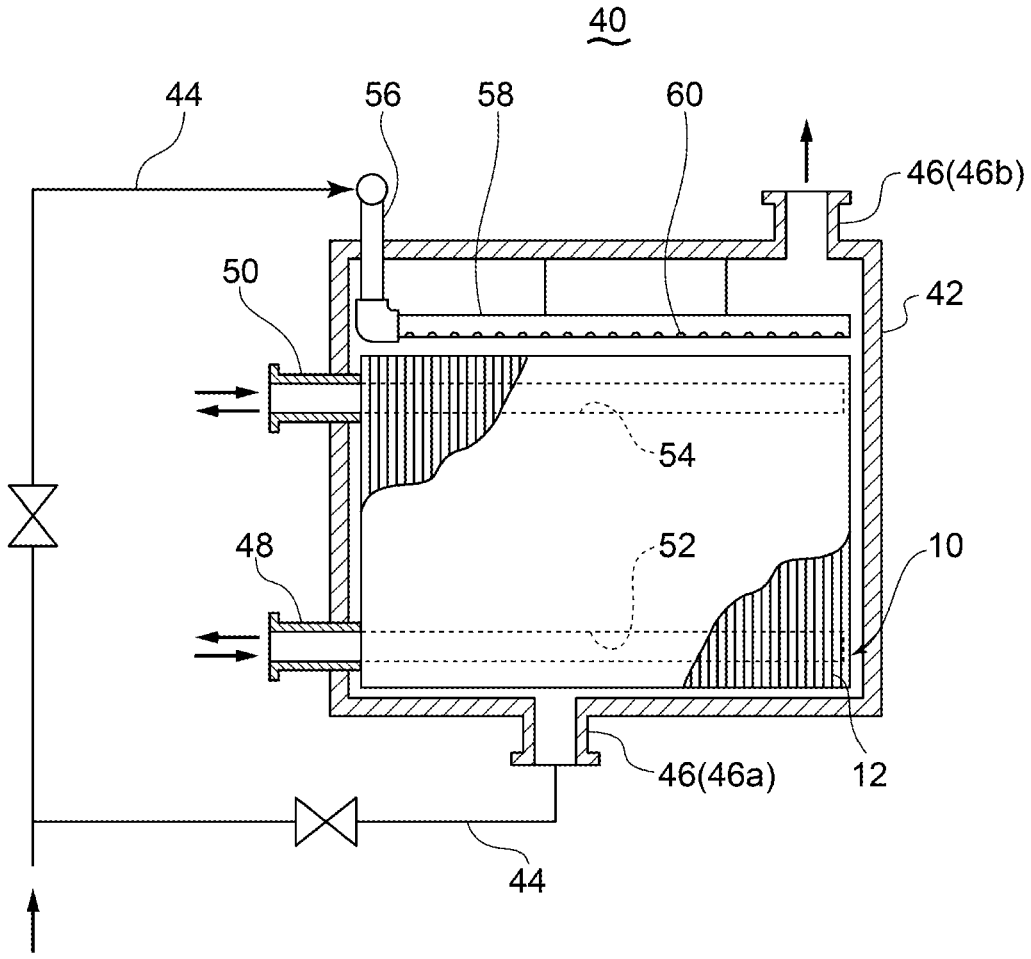

[Fig. 8]
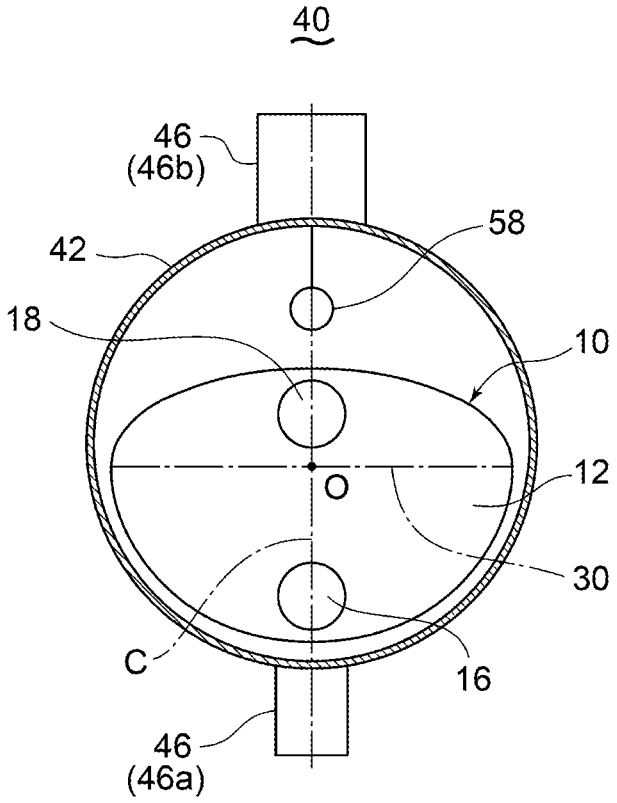

PLATE STACK AND HEAT EXCHANGER

TECHNICAL FIELD

The present disclosure relates to a plate stack and a heat exchanger including the plate stack.

BACKGROUND

A plate stack used for a plate heat exchanger, a shell-and-plate heat exchanger, or the like is formed by superimposing a large number of plates having certain corrugated patterns on both their front surfaces and back surfaces. The plate stack is configured to form one heat exchange flow passage on one surface of the front surface and the back surface of each of the plates, form another heat exchange flow passage on the other surface, and exchange heat between two heat exchange fluids respectively flowing through the two heat exchange flow passages via the plates. It is known that a heat transfer area can be thus increased, obtaining great heat exchange efficiency.

The applicant of the present invention proposes a configuration capable of reducing the size of a hollow container where a plate stack is housed by forming each plate constituting the plate stack into a non-circular shape in a shell-and-plate heat exchanger applied to, for example, an evaporator for a refrigeration device (Patent Documents 1 and 2).

If each plate is formed into the non-circular shape such as an oval shape, a lateral dimension increases, making it difficult for a heat exchange fluid (a sensible heat fluid performing sensible heat exchange, in particular) to spread into a lateral end side region, and the heat transfer area decreases. Consequently, the heat exchange performance may be decreased. Thus, in Patent Document 3, a laterally extending elongate flow restraining member referred to as a distribution member is provided on a plate surface to forcedly flow the heat exchange fluid laterally, increasing the heat transfer area and enhancing the heat exchange performance.

Citation List

Patent Literature

Patent Document 1: JP5733866B
Patent Document 2: JP2017-3175A
Patent Document 3: JP2006-527835A (translation of a PCT application)

SUMMARY

Technical Problem

Heat exchange includes sensible heat exchange without phase change in heat-exchanged fluid and latent heat exchange with phase change in heat-exchanged fluid. In a case in which a gaseous refrigerant such as $CO_2$ is condensed by latent heat exchange using a plate heat exchanger as, for example, an evaporator for a refrigeration device, if there is the flow restraining member disclosed in Patent Document 3 on a plate surface, the flow restraining member impairs the flow of a liquefied condensate liquid and is likely to cause an accumulation of the condensate liquid. The accumulation of the condensate liquid impairs liquefaction of the gaseous refrigerant, and thus the heat exchange performance may be decreased.

An object of an embodiment is to enhance the heat exchange performance in sensible heat exchange and latent heat exchange in a heat exchanger including a plate stack.

Solution to Problem (1) A plate stack according to an embodiment includes a plurality of plates each of which includes corrugated portions formed on a front surface and a back surface of each of the plurality of plates, and which are arranged in stacks, and first heat exchange flow passages through which a first heat exchange fluid flows and second heat exchange flow passages through which a second heat exchange fluid flows, the first heat exchange flow passages and the second heat exchange flow passages being formed between the plurality of plates to be arranged alternately along a stacking direction of the plurality of plates. Each of the plurality of plates has two through holes which penetrate the front surface and the back surface, and from which the first heat exchange fluid is introduced and derived. The plate stack further includes first partition weirs which are formed on at least one of two plate surfaces of a plurality of plate surfaces formed by the plurality of plates, the two plate surfaces forming a corresponding one of the first heat exchange flow passages therebetween, the first partition weirs being symmetrically arranged with respect to a center line connecting centers of the two through holes as viewed from the stacking direction of the plates so as to be oblique with respect to the center line, and a flow passage formed along the center line on a side of at least a through hole, of the two through holes, from which the first heat exchange fluid is introduced.

The phrase "symmetrically arranged with respect to the center line as viewed from the stacking direction of the plates" means that the first partition weirs which are arranged on one or both of the two plate surfaces forming the corresponding one of the first heat exchange flow passages are symmetrically arranged with respect to the center line connecting the centers of the two through holes when seen through from a plate stacking direction.

With the above configuration, since the above-described first partition weirs are symmetrically arranged with respect to the center line so as to be oblique with respect to the above-described center line and, the first heat exchange fluid flowing into the first heat exchange flow passage from one of the above-described two through holes is directed so as to flow in a direction away from these through holes (a peripheral direction of the plate surface) by the first partition weirs. Consequently, the first heat exchange fluid is dispersed to a peripheral region of the plate surface, making it possible to enhance the heat exchange performance with the second heat exchange fluid.

Further, even in a case in which the gaseous first heat exchange fluid performs latent heat exchange, since a condensate liquid obtained by condensing the gaseous first heat exchange fluid flows to an outlet-side through hole via a flow passage formed along the above-described center line (to be also referred to as a "center flow passage" hereinafter), accumulation of the condensate liquid which impairs liquefaction of a gaseous refrigerant does not occur. Therefore, without the heat exchange performance being decreased, it is possible to enhance the heat exchange performance.

(2) In an embodiment, in the above configuration (1), the first partition weirs each extend to have an arc shape which is concave toward a side of one of the two through holes.

With the above configuration (2), since the first heat exchange fluid is directed so as to flow in the peripheral direction of the plate surface along the first partition weirs each extending to have the arc shape which is concave toward the side of the one through hole, it is possible to increase the heat transfer area and to enhance the heat exchange performance with the second heat exchange fluid.

(3) In an embodiment, in the above configuration (1), the first partition weirs each extend to have an arc shape which is convex toward a side of one of the two through holes.

With the above configuration (3), since the first heat exchange fluid is directed so as to flow in the peripheral direction of the plate surface along the first partition weirs each extending to have the arc shape which is convex toward the side of the one through hole, it is possible to increase the heat transfer area and to enhance the heat exchange performance with the second heat exchange fluid.

(4) In an embodiment, in the above configuration (1), the first partition weirs extend linearly.

With the above configuration (4), since the first heat exchange fluid is directed so as to flow in the peripheral direction of the plate surface along the first partition weirs extending linearly, it is possible to increase the heat transfer area and to enhance the heat exchange performance with the second heat exchange fluid.

(5) In an embodiment, in any one of the above configurations (1) to (4), the first partition weirs include a plurality of partition weirs dispersed and arranged side by side to form a flow passage where the first heat exchange fluid meanders between the plurality of partition weirs.

With the above configuration (5), since the flow passage where the first heat exchange fluid meanders is formed, it is possible to increase the heat transfer area and to increase a heat exchange time with the second heat exchange fluid, making it possible to improve the heat exchange performance.

(6) In an embodiment, in any one of the above configurations (1) to (5), the first partition weirs are symmetrically formed with respect to the center line on each of the two plate surfaces forming the corresponding one of the first heat exchange flow passages, and the first partition weirs respectively formed on the two plate surfaces are arranged to be superimposed on each other as viewed from the stacking direction.

With the above configuration (6), since the first partition weirs are respectively formed on the two plate surfaces forming the corresponding one of the first heat exchange flow passages and are arranged to be superimposed on each other as viewed from the stacking direction, it is possible to enhance a flow restraining effect of the first partition weirs.

(7) In an embodiment, in any one of the above configurations (1) to (6), an outer edge of each of the plates is constituted by two ellipses which are same in length of a major axis and are different in ellipticity, one half of the outer edge of each of the plates is formed by one ellipse of the two ellipses having a smaller short radius than the other ellipse, and the other half of the outer edge of each of the plates is formed by the other ellipse of the two ellipses having a larger short radius than the one ellipse, and each of the plurality of plate surfaces includes a second partition weir for diverting the first heat exchange fluid from a through hole of the two through holes, the through hole being positioned far from a center point of the major axis adjacent to the through hole.

With the above configuration (7), since it is possible to match the shape of the plate stack with the shape of a hollow container housing the plate stack, it is possible to erase an extra space between the plate stack and an inner surface of the hollow container, and to reduce the size of the hollow container. Moreover, since it is possible to erase a straight section on the outer edge of each of the plates, it is possible to improve the strength of a plate joint portion, and to prevent leakage of the heat exchange fluid from the plate joint portion even if the heat exchange fluid has a high pressure.

Further, for example, in a case in which the first heat exchange fluid after heat exchange is derived from the through hole positioned far away from the center point of the above-described major axis, it is possible to form a diversion flow passage for the first heat exchange fluid on the upstream side of the through hole by providing the above-described second partition weir by the through hole. Thus, it is possible to increase the heat exchange time of the first heat exchange fluid and to improve the heat exchange performance.

(8) In an embodiment, in any one of the above configurations (1) to (7), on the two plate surfaces forming the corresponding one of the first heat exchange flow passages, the corrugated portions include corrugations extending linearly to form ridges and grooves in a cross-section of the corrugated portions, and an inclination angle of an extending direction of the corrugations with respect to the center line is larger in a region where the first partition weirs are disposed than in an outer region external to the region where the first partition weirs are disposed.

With the above configuration (8), since the first heat exchange fluid flows along the extending direction of the above-described corrugated portions, and the above-described inclination angle with respect to the center line is set as the inclination angle of the above-described corrugated portions, the first heat exchange fluid is directed so as to flow to the side of a peripheral edge portion of the plate surface. Thus, it is possible to elongate the flow passage for the first heat exchange fluid and to increase the heat transfer area, making it possible to improve the heat exchange performance.

(9) In an embodiment, in any one of the above configurations (1) to (8), the plurality of plates include a plurality of paired plates each of which is formed by adjacent two of the plurality of plates that are joined on peripheral edge portions of the two through holes, and adjacent two of the paired plates are joined on outer edge portions of the plate surfaces facing each other.

With the above configuration (9), it is possible to efficiently manufacture the plate stack where the first heat exchange flow passages and the second heat exchange flow passages are alternately arranged on both sides of each of the plurality of plates.

(10) In an embodiment, in the above configuration (9), the plurality of plates include plates of the same shape having the corrugated portions of the same shape, and the paired plate include a first plate, and a second plate which is inverted with the center line as a center and is oppositely arranged to the first plate. With the above configuration (10), since it is possible to form all the plates constituting the plate stack into the same shape, it is possible to make a manufacturing process of the respective plates simple and less expensive.

(11) A heat exchanger according to an embodiment includes a hollow container, the plate stack according to any one of the above configurations (1) to (10) arranged inside the hollow container, a supply pipe for supplying the second heat exchange fluid to the hollow container, a discharge pipe for discharging the second heat exchange fluid from the hollow container, an introduction pipe for introducing the first heat exchange fluid to one of the two through holes, and a derivation pipe for deriving the first heat exchange fluid from the other of the two through holes.

With the above configuration (11), since the first heat exchange fluid is dispersed to a peripheral region of the plate surface by housing the plate stack having the above configuration inside the hollow container, it is possible to enhance the heat exchange performance with the second heat exchange fluid. Further, even in a case in which the gaseous first heat exchange fluid performs latent heat exchange, since a condensate liquid obtained by condensing the gaseous first heat exchange fluid flows to an outlet-side through hole via a center flow passage formed along the center line, accumulation of the condensate liquid which impairs liquefaction of a gaseous refrigerant does not occur. Therefore, it is possible to enhance the heat exchange performance.

(12) In an embodiment, in the above configuration (11), the plate stack is arranged such that the center line is along a vertical direction inside the hollow container.

With the above configuration (12), since the liquid first heat exchange fluid which flows in from the through hole arranged on the lower side is dispersed to the entire plate surface along the first partition weirs when performing sensible heat exchange with the second heat exchange fluid, it is possible to improve the heat exchange performance. Further, when the gaseous first heat exchange fluid flows in from the through hole arranged on the upper side, the condensate liquid obtained by condensing the gaseous first heat exchange fluid smoothly flows to the outlet-side through hole via the center flow passage, and thus accumulation of the condensate liquid which impairs liquefaction of the gaseous refrigerant does not occur. Therefore, it is possible to suppress the decrease in the heat exchange performance.

(13) In an embodiment, in the above configuration (11) or (12), an outer edge of each of the plates is constituted by two ellipses which are same in length of a major axis and are different in ellipticity, an upper half of the outer edge of each of the plates is formed by one ellipse of the two ellipses having a smaller short radius than the other ellipse, and a lower half of the outer edge of each of the plates is formed by the other ellipse of the two ellipses having a larger short radius than the one ellipse.

With the above configuration (13), since it is possible to reduce the size of the hollow container and to erase the straight section on the outer edge of each of the plates as described above, it is possible to improve the strength of a plate joint portion, and to suppress leakage of the heat exchange fluid from the plate joint portion.

(14) In an embodiment, in the above configuration (13), of the two through holes, a through hole positioned far away from a center point of the major axis is arranged on a lower side, and a through hole positioned close to the center point of the major axis is arranged on an upper side.

With the above configuration (14), since the liquid first heat exchange fluid which flows in from the through hole arranged on the lower side is dispersed to the entire plate surface along the first partition weirs, it is possible to improve the heat exchange performance. Further, when the gaseous first heat exchange fluid flows in from the through hole arranged on the upper side, the condensate liquid obtained by condensing the gaseous first heat exchange fluid flows to the outlet-side through hole via the center flow passage, and thus accumulation of the condensate liquid which impairs liquefaction of the gaseous refrigerant does not occur. Therefore, it is possible to suppress the decrease in the heat exchange performance.

Advantageous Effects

According to some embodiments, it is possible to suppress a decrease in the heat exchange performance and to enhance the heat exchange performance even if the first heat exchange fluid flowing through the first heat exchange flow passage formed in a plate stack performs not only sensible heat exchange without phase change in heat exchange fluid but also latent heat exchange with phase change in heat exchange fluid, and even if the plate stack is constituted by non-circular plates.

BRIEF DESCRIPTION OF DRAWINGS

FIG. 1 is a schematic process drawing of an example of a manufacturing process of a plate stack.

FIG. 2 is a front view of a plate constituting the plate stack according to an embodiment.

FIG. 3 is a front view of a paired plate constituting the plate stack according to an embodiment.

FIG. 4 is a front view of the paired plate constituting the plate stack according to an embodiment.

FIG. 5A is a schematic view of a plate surface including the first partition weirs according to an embodiment.

FIG. 5B is a schematic view of the plate surface including the first partition weirs according to an embodiment.

FIG. 5C is a schematic view of the plate surface including the first partition weirs according to an embodiment.

FIG. 5D is a schematic view of the plate surface including the first partition weirs according to an embodiment.

FIG. 6 is a schematic view of a contour shape of the plate according to an embodiment.

FIG. 7 is a vertical cross-sectional view of a heat exchanger according to an embodiment.

FIG. 8 is a side cross-sectional view of the heat exchanger according to an embodiment.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same", "equal", and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain", and "constitute" are not intended to be exclusive of other components.

FIG. 1 shows an example of a manufacturing process of a plate stack 10. FIG. 1 shows plates 12 each constituted by a circular plate. The plate stack 10 is formed by arranging the plurality of plates 12 in stacks. The plates 12 include corrugated portions 14 formed on their front surface and back surface. The corrugated portions 14 form flow passages between the respective plates 12. That is, first heat exchange flow passages $F_1$ and second heat exchange flow passages $F_2$ are formed to be arranged alternately along a plate stacking direction, and heat exchange is performed between the first heat exchange fluid and the second heat exchange fluid via the respective plates 12. The first heat exchange fluid flows through the first heat exchange flow passages $F_1$, and the second heat exchange fluid flows through the second heat exchange flow passages $F_2$. The plates 12 each have two through holes 16 and 18 penetrating its front surface and back surface, and communicating with the first heat exchange flow passages $F_1$. The first heat exchange fluid is introduced from one of the through hole 16 or 18, and is derived from the other of the through hole 16 or 18.

In an embodiment, as shown in FIG. 1, an adjacent pair of plates 12 (12*a*) and 12 (12*b*) of the plurality of plates 12 are joined by welding or the like on peripheral edge portions 16*a* and 18*a* forming the peripheral edges of the through holes 16 and 18 of the plate surfaces, thereby constituting one paired plate 20. The second heat exchange flow passage $F_2$ is formed between the pair of plates 12 (12*a*) and 12 (12*b*) constituting the one paired plate 20. Next, adjacent paired plates are coupled on outer edge portions 20*a* of the plate surfaces facing each other (outer edge portions of surfaces on opposite sides to surfaces having the peripheral edge portions 16*a* and 18*a* which are joined each other), manufacturing the plate stack 10. The first heat exchange flow passage $F_1$ is formed between outer plate surfaces of the pair of plates 12 (12*a* and 12*b*) forming the paired plate 20. According to the manufacturing method, it is possible to efficiently manufacture the plate stack 10 where the first heat exchange flow passages $F_1$ and the second heat exchange flow passages $F_2$ are alternately arranged on both sides of the respective plates 12.

In an embodiment, the plurality of plates 12 each include a plate of the same shape having the corrugated portion 14 of the same shape. As shown in FIG. 1, one plate 12 (12*b*) of the paired plate 20 is inverted with a center line C passing through the centers of the two through holes 16 and 18 as the center and is oppositely arranged to the other plate 12 (12*a*).

According to the present embodiment, since it is possible to form all the plates 12 constituting the plate stack 10 into the same shape, it is possible to make a manufacturing process of the plates 12 simple and less expensive.

In an embodiment, in the plate stack 10, the two through holes formed on one of the plates 12 are respectively arranged to be superimposed on those on the other of the plates 12 as viewed from the stacking direction. Thus, it is possible to linearly form two supply/exhaust passages through which the first heat exchange fluid flows in the plate stack 10.

Each of FIGS. 2 to 4 is a front view of the plate surface of the plate 12 according to an embodiment. FIG. 2 shows the plate surface of one of two plates forming the first heat exchange flow passage $F_1$. FIGS. 3 and 4 are views of two plate surfaces each forming the first heat exchange flow passage $F_1$ as viewed from the stacking direction.

On at least one of the two plate surfaces forming the first heat exchange flow passage $F_1$, partition weirs (first partition weirs) 22 are formed. The partition weirs 22 are symmetrically arranged with respect to the center line C connecting the respective centers of the two through holes 16 and 18 so as to be oblique with respect to the center line C. In this case, the partition weirs 22 may symmetrically be arranged only on one of the plate surfaces, or the partition weirs 22 may at least partially be arranged on the two plate surfaces, and display symmetry in combination of the two plate surfaces as viewed from the plate stacking direction.

In addition, a center flow passage 24 along the center line C is formed on the side of at least the through hole of the two through holes 16 and 18 where the first heat exchange fluid is introduced.

According to the above-described configuration, the first heat exchange fluid flowing into the first heat exchange flow passage $F_1$ from one of the two through holes 16 and 18 is directed so as to flow in a direction away from the center line C (a peripheral direction of the plate surface) by the partition weirs 22. Consequently, the first heat exchange fluid is dispersed to a peripheral region of the plate surface, making it possible to increase the heat transfer area with the second heat exchange fluid and to enhance the heat exchange performance. Further, even in a case in which the gaseous first heat exchange fluid performs latent heat exchange, since the center flow passage 24 is formed, a condensate liquid obtained by condensing the gaseous first heat exchange fluid in the first heat exchange flow passage $F_1$ flows to an outlet-side through hole via the center flow passage 24 without accumulating near the through hole where the liquid is introduced, and thus accumulation of the condensate liquid which impairs liquefaction of a gaseous fluid does not occur. Therefore, it is possible to maintain the high heat exchange performance. Therefore, it is possible to deal with both sensible heat exchange and latent heat exchange with one type of plate stack, making it possible to reduce the manufacturing cost of the plate stack 10.

The partition weirs 22 may each extend to have an arc shape which is convex or concave toward the side of the one through hole of the two through holes 16 and 18, or may extend linearly. With any shape, since the first heat exchange fluid is directed so as to flow in the direction away from the center line C by the partition weirs 22, it is possible to take a long heat exchange time with the second heat exchange fluid, and thus to enhance the heat exchange performance with the second heat exchange fluid.

FIGS. 3 and 4 each show the plate including the partition weirs 22 according to an embodiment. In the present example, as the plate stack 10 shown in FIG. 7, the plates 12 are each arranged along the vertical direction, and are each arranged to have the through hole 16 on the lower side and the through hole 18 on the upper side. FIG. 3 shows a case of sensible heat exchange in which a sensible heat fluid such as cooling water or brine is introduced from the through hole 16 to the first heat exchange flow passage $F_1$ as the first heat exchange fluid, performs sensible heat exchange with the second heat exchange fluid, and then is derived from the through hole 18 while kept in a liquid form. FIG. 4 shows a case in which a gaseous latent heat fluid such as $CO_2$ is introduced from the through hole 18 to the first heat exchange flow passage $F_1$ as the first heat exchange fluid, performs latent heat exchange with the second heat exchange fluid such as $NH_3$, is liquefied, and is derived from the through hole 16. In FIGS. 3 and 4, arrows "a" and "b" each indicate the flow direction of the first heat exchange fluid.

The partition weirs 22 of the present embodiment include a plurality of partition weirs each extending to have the arc shape which is concave toward the side of the through hole 16 and being symmetrically formed with respect to the respective center lines C on the two plate surfaces forming the first heat exchange flow passage. Furthermore, the partition weirs 22 respectively formed on the two plate surfaces are arranged to be superimposed on each other as viewed from the plate stacking direction. Thus, it is possible to enhance a flow restraining effect of the partition weirs 22.

Furthermore, in an embodiment, it is possible to further enhance the flow restraining effect of the partition weirs 22 if end surfaces of the partition weirs 22 respectively formed on the two plate surfaces are arranged so as to contact each other.

In FIG. 3, the sensible heat fluid introduced from the through hole 16 flows through the entire plate surface including the peripheral region of the plate surface by the partition weirs 22 and is derived from the through hole 18. The same also applies to FIG. 4 in which since the center flow passage 24 is vertically formed along the center line C, a condensate liquid obtained by condensation in the first heat exchange flow passage $F_1$ smoothly flows to the through hole 16 via the center flow passage 24 without accumulating near the through hole 16 if the gaseous first heat exchange fluid is introduced from the through hole 18 to the first heat exchange flow passage $F_1$ and performs latent heat exchange, and thus the accumulation of the condensate liquid which impairs liquefaction of the gaseous fluid does not occur.

FIGS. 5A to 5D each show the plate surface including the partition weirs 22 according to some other embodiments. In the present embodiments, an outer edge shape of the plate 12 is formed by two ellipses same in length of a major axis 30 and different in ellipticity, as will be described later. None of FIGS. 5A to 5D shows the corrugated portion 14.

In FIG. 5A, the plurality of partition weirs each extend to have the arc shape which is convex toward the through hole 16. In FIG. 5B, the plurality of partition weirs arranged in two rows on one side each extend to have the arc shape which is concave toward the side of the through hole 16, as in FIG. 3. In addition, in the embodiments shown in FIGS. 5A and 5B, the center flow passage 24 is formed between the through holes 16 and 18 along the center line C.

In FIG. 5C, the partition weirs 22 include the plurality of partition weirs dispersed and arranged side by side to form flow passages where the first heat exchange fluid meanders between the plurality of partition weirs. That is, a flow passage capable of diverting the fluid is formed at one end of one partition weir, and in a partition weir outside the partition weir, a flow passage capable of diverting the fluid is formed at an end on the opposite side to the partition weir. Therefore, it is possible to form the flow passages capable of diverting the fluid between these partition weirs. Since the flow passages where the first heat exchange fluid meanders are thus formed, it is possible to take the long heat exchange time with the second heat exchange fluid, and thus to improve the heat exchange performance.

Furthermore, in the embodiment shown in FIG. 5C, the respective partition weirs constituting the partition weirs 22 extend from the through hole 18 toward the through hole 16 to be oblique outward from the center line C. Then, the sensible heat fluid introduced from the through hole 16 to the first heat exchange flow passage $F_1$ flows from the center side to the peripheral region of the plate surface while meandering along the respective partition weirs. Thus, it is possible to increase the heat exchange time with the second heat exchange fluid and to improve the heat exchange performance.

The embodiment shown in FIG. 5D includes the partition weirs 22 each having the arc shape which is convex toward the side of the through hole 16. The partition weirs 22 include the plurality of partition weirs dispersed and arranged side by side so as to allow the first heat exchange fluid to meander between the respective partition weirs. In addition, between the through holes 16 and 18, a partition weir 26 is disposed adjacent to the through hole 16, and owing to small gaps between the partition weir 26 and the partition weirs constituting the partition weirs 22, the first heat exchange fluid introduced from the through hole 16 to the first heat exchange flow passage $F_1$ flows along the outer edge of the plate surface, and then meanders between the partition weirs toward the inside of the plate surface.

In an embodiment, as shown in FIG. 6, the outer edge shape of the plate 12 is formed by the two ellipses same in length of the major axis 30 and different in ellipticity. That is, one half of the outer edge of the plate 12 is formed by an ellipse 34 of the two ellipses, and the other half of the outer edge of the plate is formed by an ellipse 36 of the two ellipses. The ellipse 34 has a smaller short radius of a minor axis 32 than the ellipse 36, and the ellipse 36 has a larger short radius of the minor axis 32 than the ellipse 34.

Thus, it is possible to match the shape of the plate stack 10 with the shape of a hollow container to be described later, making it possible to erase an extra space between the plate stack 10 and an inner surface of the hollow container, and to reduce the size of the hollow container. Moreover, without a straight section on the outer edge of the plate 12, it is possible to improve the strength of a plate joint portion between the paired plates joined by welding or the like, and to suppress leakage of the first heat exchange fluid from the plate joint portion even if the pressure of the first heat exchange fluid or the second heat exchange fluid increases.

Furthermore, in an embodiment, the plate surface includes the partition weir (second partition weir) 26 for diverting the first heat exchange fluid from the through hole 16 of the two through holes 16 and 18, the through hole 16 being positioned far from a center point O of the major axis 30.

According to the present embodiment, for example, in a case in which the first heat exchange fluid after heat exchange is derived from the through hole 16, with the partition weir 26, it is possible to form a flow passage which diverts the first heat exchange fluid from the through hole 16 before the through hole 16. Thus, it is possible to increase the heat exchange time of the first heat exchange fluid and to improve the heat exchange performance.

In an embodiment, as shown in FIGS. 3 and 4, on the two plate surfaces forming the first heat exchange flow passage $F_1$, the corrugated portions 14 include corrugations extending linearly to form ridges and grooves in a cross-section of the corrugated portions 14. An inclination angle of an extending direction of the corrugations with respect to the center line C is larger in a region B where the partition weirs 22 are arranged than in an outer region A external to the partition weirs 22.

According to the present embodiment, since the first heat exchange fluid flows along the above-described extending direction of the corrugated portions, and the inclination angle of the corrugated portions 14 with respect to the center line C is set as described above, the first heat exchange fluid is directed so as to flow to the side of the peripheral edge portion of the plate surface. Thus, it is possible to elongate the flow passage for the first heat exchange fluid on the plate surface, making it possible to improve the heat exchange performance. That is, as shown in FIG. 3, in the region A, due to a small inclination angle of the extending direction of the corrugations with respect to the center line C, the first heat exchange fluid flows in the peripheral direction of the plate surface while being dispersed widely. Thus, it is possible to increase the heat transfer area and to improve the heat exchange performance. Moreover, in the region B, due to a large inclination angle of the extending direction of the corrugations with respect to the center line C, the first heat exchange fluid rapidly flows in the peripheral direction of the plate surface along the partition weirs 22. In the region B, because of a long distance to the peripheral edge of the plate surface in the lateral direction, it is possible to hasten the arrival at the peripheral edge by increasing a speed at which the first heat exchange fluid flows in the peripheral direction.

As shown in FIG. 7, a shell-and-plate heat exchanger 40 (to be also simply referred to as the "heat exchanger 40" hereinafter) according to an embodiment houses the plate stack 10 inside a hollow container 42. To the hollow container 42, a supply line 44 and discharge pipes 46 are connected. The supply line 44 supplies the second heat exchange fluid. The discharge pipes 46 discharge, from the hollow container 42, the second heat exchange fluid after exchanging heat with the first heat exchange fluid. In addition, to the hollow container 42, two supply/discharge pipes 48 and 50 are connected. The supply/discharge pipes 48 and 50 introduces the first heat exchange fluid from one of the two through holes 16 and 18 and derives the first heat exchange fluid from the other. The hollow container 42 houses the plate stack 10. The through holes 16 formed on the respective plates 12 form a through passage 52 in the stacking direction of the plates 12. The through holes 18 formed on the respective plates 12 form a through passage 54 in the stacking direction of the plates 12.

In an embodiment, on the respective plates 12, the through holes 16 and 18 are formed on the identical positions on the plate surfaces, and form the linear through passages.

If the liquid second heat exchange fluid supplied from the supply line 44 performs sensible heat exchange or latent heat exchange by the heat exchanger 40, the liquid fluid after the sensible heat exchange is discharged from the discharge pipe 46 (46*a*), and the gaseous fluid after the latent heat exchange is discharged from the discharge pipe 46 (46*b*).

When the heat exchanger 40 serves as a condenser used for a refrigeration device, the liquid first heat exchange fluid (for example, cooling water, brine, or the like) introduced from the supply/discharge pipe 48 via the through passage 52 performs sensible heat exchange with a gaseous refrigerant (first heat exchange fluid) in the plate stack 10, and the liquid first heat exchange fluid after the sensible heat exchange is discharged from the supply/discharge pipe 50 via the through passage 54.

When the heat exchanger 40 serves as an evaporator used for a refrigeration device, the second heat exchange fluid (for example, an $NH_3$ refrigerant) is supplied to the hollow container 42 from the supply line 44, turns into a gas form by performing latent heat exchange in the plate stack 10, and is discharged from the discharge pipe 46 (46*b*) to a compressor (not shown).

When the heat exchanger 40 serves as a liquid reservoir used for an $NH_3/CO_2$ dual refrigerator, a gaseous $CO_2$ refrigerant introduced as the first heat exchange fluid from the supply/discharge pipe 50 performs latent heat exchange in the plate stack 10, and a liquid $CO_2$ refrigerant after the latent heat exchange is discharged from the supply/discharge pipe 48. A liquid $NH_3$ refrigerant supplied to the hollow container 42 from the supply line 44 as the second heat exchange fluid is supplied to the hollow container 42, turns into a gas form by performing latent heat exchange in the plate stack 10, and is discharged from the discharge pipe 46 (46*b*).

Since the heat exchanger 40 includes the plate stack 10, it is possible to enhance the heat exchange performance between the first heat exchange fluid and the second heat exchange fluid, as described above.

In an embodiment, the supply line 44 is connected to a nozzle pipe 58 disposed inside the hollow container 42 via a pipe passage 56. The nozzle pipe 58 is arranged in the stacking direction of the plate stack 10 in the upper part of the hollow container, and a large number of nozzle ports 60 are formed in the axial direction. The first heat exchange fluid is dropped from the nozzle ports 60 toward the plate stack 10. In addition, the hollow container 42 includes an outlet (not shown) for extracting accumulated oil on its bottom.

In an embodiment, as shown in FIG. 8, the plate stack 10 is arranged such that the center line C is along the vertical direction inside the hollow container 42. Consequently, the through holes 16 and 18 are arranged one above the other along the center line C. When the liquid first heat exchange fluid is introduced from the through hole 16 arranged on the lower side and performs sensible heat exchange, the liquid first heat exchange fluid is dispersed to the entire plate surface along the partition weirs 22, making it possible to improve the heat exchange performance. Further, when the gaseous first heat exchange fluid is introduced from the through hole 18 arranged on the upper side and performs latent heat exchange, the condensate liquid obtained by condensing the gaseous first heat exchange fluid in the first heat exchange flow passage $F_1$ rapidly flows down to the outlet-side through hole 16 via the center flow passage 24, and thus accumulation of the condensate liquid which impairs liquefaction of the gaseous fluid does not occur. Therefore, it is possible to suppress the decrease in the heat exchange performance.

In an embodiment, as described above, the outer edge shape of the plate 12 is formed by the two ellipses which are same in length of the major axis 30, sharing the major axis 30, and are different in ellipticity, the upper half of the outer edge of the plate 12 is formed by the ellipse 34 of the two ellipses, and the lower half of the outer edge of the plate 12 is formed by the ellipse 36 of the two ellipses. The ellipse 34 has the smaller short radius of the minor axis 32 than the ellipse 36, and the ellipse 36 has the larger short radius of the minor axis 32 than the ellipse 34.

Thus, it is possible to match the shape of the plate stack 10 with the shape of the hollow container 42, making it possible to erase the extra space between the plate stack 10 and the inner surface of the hollow container, and to reduce the size of the hollow container 42. Moreover, without the straight section on the outer edge of the plate 12, it is possible to improve the strength of the plate joint portion, and to prevent leakage of the heat exchange fluid from the plate joint portion. When the heat exchanger 40 is used for the evaporator or the liquid reservoir of the refrigeration device, the first heat exchange fluid is the gaseous $CO_2$ refrigerant, and the second heat exchange fluid is the $NH_3$ refrigerant, it is possible to prevent leakage from the plate joint portion joined by welding or the like even in a case in which the first heat exchange flow passage $F_1$ and the second heat exchange flow passage $F_2$ reach a high pressure of about 4.0 MPa.

In an embodiment, of the through holes 16 and 18, the through hole 16 positioned far away from the center point O of the major axis 30 is arranged on the lower side, and the through hole 18 positioned close to the center point O is arranged on the upper side.

According to the present embodiment, since the liquid first heat exchange fluid which flows in from the through hole 16 arranged on the lower side is dispersed to the entire plate surface along the partition weirs 22, it is possible to improve the heat exchange performance. Further, when the gaseous first heat exchange fluid flows in from the through hole 18 arranged on the upper side, the condensate liquid obtained by condensing the gaseous first heat exchange fluid flows to the outlet-side through hole 16 via the center flow passage 24, and thus accumulation of the condensate liquid which impairs liquefaction of the gaseous fluid does not occur. Therefore, it is possible to suppress the decrease in the heat exchange performance.

Industrial Applicability

According to some embodiments, it is possible to implement a plate stack without any decrease in the heat exchange performance even at a time of not only sensible heat exchange without phase change in heat exchange fluid but also latent heat exchange with phase change in heat exchange fluid, and even if the plate stack is constituted by non-circular plates. Therefore, it is possible to deal with sensible heat exchange and latent heat exchange with one type of plate stack when applied to a heat exchanger such as an evaporator, a condenser, or the like for a refrigeration device, making it possible to reduce a manufacturing cost of the heat exchanger.

REFERENCE SIGNS LIST

10 Plate stack
12 (12*a*, 12*b*) Plate
14 Corrugated portion
16, 18 Through hole
16*a*, 18*a* Peripheral edge portion
20 Paired plate
20*a* Outer edge portion
22 Partition weir (first partition weir)
24 Center flow passage
26 Partition weir (second partition weir)
30 Major axis
32 Minor axis
34, 36 Ellipse
40 Heat exchanger
42 Hollow container
44 Supply line
46 (46*a*, 46*b*) Discharge pipe
48, 50 Supply/discharge pipe
52, 54 Through passage
56 Pipe passage
58 Nozzle pipe
60 Nozzle port
C Center line
$F_1$ First heat exchange flow passage
$F_2$ Second heat exchange flow passage
O Center point

The invention claimed is:

1. A plate stack comprising:

a plurality of plates each of which includes corrugated portions formed on a front surface and a back surface of each of the plurality of plates, and which are arranged in stacks; and first heat exchange flow passages through which a first heat exchange fluid flows and second heat exchange flow passages through which a second heat exchange fluid flows, the first heat exchange flow passages and the second heat exchange flow passages being formed between the plurality of plates to be arranged alternately along a stacking direction of the plurality of plates, wherein each of the plurality of plates has two through holes which penetrate the front surface and the back surface, and from which the first heat exchange fluid is introduced and derived, and wherein the plate stack further comprises:

first partition weirs which are formed on at least one of two plate surfaces of a plurality of plate surfaces formed by the plurality of plates, the two plate surfaces forming a corresponding one of the first heat exchange flow passages therebetween, the first partition weirs being symmetrically arranged with respect to a center line connecting centers of the two through holes as viewed from the stacking direction of the plates so as to be oblique with respect to the center line; and a flow passage formed along the center line on a side of at least a through hole, of the two through holes, from which the first heat exchange fluid is introduced.

2. The plate stack according to claim 1, wherein the first partition weirs each extend to have an arc shape which is concave toward a side of one of the two through holes.

3. The plate stack according to claim 1, wherein the first partition weirs each extend to have an arc shape which is convex toward a side of one of the two through holes.

4. The plate stack according to claim 1, wherein the first partition weirs extend linearly.

5. The plate stack according to claim 1, wherein the first partition weirs include a plurality of partition weirs dispersed and arranged side by side to form a flow passage where the first heat exchange fluid meanders between the plurality of partition weirs.

6. The plate stack according to claim 1, wherein the first partition weirs are symmetrically formed with respect to the center line on each of the two plate surfaces forming the corresponding one of the first heat exchange flow passages, and wherein the first partition weirs respectively formed on the two plate surfaces are arranged to be superimposed on each other as viewed from the stacking direction.

7. The plate stack according to claim 1, wherein an outer edge of each of the plates is constituted by two ellipses which are same in length of a major axis and are different in ellipticity, one half of the outer edge of each of the plates is formed by one ellipse of the two ellipses having a smaller short radius than the other ellipse, and the other half of the outer edge of each of the plates is formed by the other ellipse of the two ellipses having a larger short radius than the one ellipse, and wherein each of the plurality of plate surfaces includes a second partition weir for diverting the first heat exchange fluid from a through hole of the two through holes, the through hole being positioned far from a center point of the major axis adjacent to the through hole.

8. The plate stack according to claim 1, wherein, on the two plate surfaces forming the corresponding one of the first heat exchange flow passages, the corrugated portions include corrugations extending linearly to form ridges and grooves in a cross-section of the corrugated portions, and wherein an inclination angle of an extending direction of the corrugations with respect to the center line is larger in a region where the first partition weirs are disposed than in an outer region external to the region where the first partition weirs are disposed.

9. The plate stack according to claim 1, wherein the plurality of plates include a plurality of paired plates each of which is formed by adjacent two of the plurality of plates that are joined on peripheral edge portions of the two through holes, and adjacent two of the paired plates are joined on outer edge portions of the plate surfaces facing each other.

10. The plate stack according to claim 9, wherein the plurality of plates include plates of the same shape having the corrugated portions of the same shape, and wherein each of the paired plates includes a first plate, and a second plate which is inverted with the center line as a center and is oppositely arranged to the first plate.

11. A heat exchanger comprising:

a hollow container;

a plate stack arranged inside the hollow container; the plate stack comprising:

a plurality of plates each of which includes corrugated portions formed on a front surface and a back surface of each of the plurality of plates, and which are arranged in stacks; and first heat exchange flow passages through which a first heat exchange fluid flows and second heat exchange flow passages through which a second heat exchange fluid flows, the first heat exchange flow passages and the second heat exchange flow passages being formed between the plurality of plates to be arranged alternately along a stacking direction of the plurality of plates, wherein each of the plurality of plates has two through holes which penetrate the front surface and the back surface, and from which the first heat exchange fluid is introduced and derived, and wherein the plate stack further comprises:

first partition weirs which are formed on at least one of two plate surfaces of a plurality of plate surfaces formed by the plurality of plates, the two plate surfaces forming a corresponding one of the first heat exchange flow passages therebetween, the first partition weirs being symmetrically arranged with respect to a center line connecting centers of the two through holes as viewed from the stacking direction of the plates so as to be oblique with respect to the center line; and a flow passage formed along the center line on a side of at least a through hole, of the two through holes, from which the first heat exchange fluid is introduced;

a supply pipe for supplying the second heat exchange fluid to the hollow container;

a discharge pipe for discharging the second heat exchange fluid from the hollow container;

an introduction pipe for introducing the first heat exchange fluid to one of the two through holes; and a derivation pipe for deriving the first heat exchange fluid from the other of the two through holes.

12. The heat exchanger according to claim 11, wherein the plate stack is arranged such that the center line is along a vertical direction inside the hollow container.

13. The heat exchanger according to claim 11, wherein an outer edge of each of the plates is constituted by two ellipses which are same in length of a major axis and are different in ellipticity, an upper half of the outer edge of each of the plates is formed by one ellipse of the two ellipses having a smaller short radius than the other ellipse, and a lower half of the outer edge of each of the plates is formed by the other ellipse of the two ellipses having a larger short radius than the one ellipse.

14. The heat exchanger according to claim 13, wherein, of the two through holes, a through hole positioned far away from a center point of the major axis is arranged on a lower side, and a through hole positioned close to the center point of the major axis is arranged on an upper side.

* * * * *